US005193939A

United States Patent [19]

Nagatani et al.

[11] Patent Number: 5,193,939

[45] Date of Patent: Mar. 16, 1993

[54] MARINE STRUCTURE HAVING SUPERIOR CORROSION RESISTANCE

[75] Inventors: Taiji Nagatani, Futtsu; Seiichi Soeda, Tokyo; Kazuo Sakai, Tokyo; Yasuo Takahashi, Tokyo, all of Japan

[73] Assignees: Nippon Steel Corporation; Trans-Tokyo Bay Highway Corporation, both of Tokyo, Japan

[21] Appl. No.: 791,913

[22] Filed: Nov. 13, 1991

[30] Foreign Application Priority Data

Nov. 16, 1990 [JP] Japan ..... 2-310822
Jun. 24, 1991 [JP] Japan ..... 3-152043

[51] Int. Cl.[5] ..... E02D 31/06

[52] U.S. Cl. ..... 405/211; 204/147; 204/196; 405/203; 405/195.1

[58] Field of Search ..... 405/211, 217, 216, 195.1; 204/196, 147

[56] References Cited

U.S. PATENT DOCUMENTS 4,427,320 1/1984 Bhula ..... 405/217 X
4,659,255 4/1987 Shiraishi et al. ..... 405/211 X
4,692,066 9/1987 Clear ..... 405/211 X

FOREIGN PATENT DOCUMENTS 62-44948 3/1987 Japan .
2-52176 2/1990 Japan .
2-280969 11/1990 Japan .
2-280970 11/1990 Japan .

*Primary Examiner*—Dennis L. Taylor
*Attorney, Agent, or Firm*—Kenyon & Kenyon

[57] ABSTRACT

A marine structure has a surface corrosion resistant covering material of titanium-clad steel plates that are continuously arranged in vertical and horizontal directions. Long sides of the titanium-clad steel plates at the top and bottom steps of the corrosion resistant covering material are horizontally arranged to minimize the number of joints between adjacent titanium-clad steel plates, and a space exposed at an end of each joint at the top and bottom steps of the corrosion resistant covering material is closed with a sealing cover.

7 Claims, 4 Drawing Sheets

MARINE STRUCTURE HAVING SUPERIOR CORROSION RESISTANCE

BACKGROUND OF THE INVENTION

1. Field of the Invention

The present invention relates to a marine structure having superior corrosion resistance, and particularly to a marine structure having a titanium-clad steel plates being joined together in the many number of exposed joint ends.

2. Description of the Related Art

A marine structure usually involves legs made of square materials or steel pipes. The surface of each leg is treated with a corrosion resistant treatment, e.g., painting etc, to protect against sea water corrosion. This surface corrosion resistant treatment is not sufficient to protect the marine structure for years against splashing sea water. An area of the marine structure affected by the splashing sea water is called the splash zone and extends along the marine structure at sea water level.

To protect a marine structure at the splash zone from corrosion, as shown Japanese Unexamined Utility Model Publication No. 62-44948, the marine structure is coiled and covered with titanium-clad steel plates having superior corrosion resistance.

In the past, after the titanium-clad steel plates were disposed around the legs at the splash zone, ends of the titanium-clad steel plates were welded together.

But, since it was difficult to weld titanium to steel, various improved techniques have been proposed for this purpose. For example, Japanese Unexamined Patent Publication No. 2-52176 describes a recess formed on a steel at a boundary between a titanium layer and a carbon steel layer of each titanium-clad steel plate, and the recess is filed with an inert gas or a backing strip is inserted in the recess, in treating a butt welding, thereafter, the titanium layer and steel layer are individually welded with an uranami welding technique. Alternatively, Japanese Unexamined Patent Publication Nos. 2-280970 and 2-280969 disclose a technique of avoiding forming a joint of dissimilar metals.

FIGS. 5(*a*) and 5(*b*) in the present specification show examples of conventional methods of joining titanium-clad steel plates 1 together. Each of the plates 1 is made of a base layer 2 mainly composed of Fe and a titanium layer 3.

In FIG. 5(*a*), ends 4 of the base layers 2 of the titanium-clad steel plates 1 are welded together, and the titanium layers 3 are welded with a titanium spacer 6 to form titanium weld portions 7. This method forms a space 10 between the surface of the end 4 of the base layers 2 and the spacer 6, so that sea water may enter into the space 10 to corrode the base layers 2. In addition, the space 10 deteriorates the strength of the welded part. Further, the base layers 2 partly melt when the layers 3 and spacer 6 are welded together, and the molten metal is mixed with deposited metal of the weld portions 7 to produce a brittle layer of compounds such as TiC and TiN, or of intermetallic compounds such as Fe-Ti. This may cause cracks.

To prevent a formation of such a brittle layer, the method of FIG. 5(*b*) does not weld the spacer 6 with the titanium layers 3. Instead, the spacer 6 is only disposed between the titanium layers 3, and a patch plate 8 is placed over the spacer 6 and titanium layers 3. The patch plate 8 is joined with the titanium layers 3 by forming lap fillet weld portions 9. The patch plate 8 is made of titanium, similar to the titanium layers 3 and spacer 6, so that the brittle layers are not formed at the lap fillet weld portions 9.

This method, however, presents a complicated weld structure and forms a large space 10 when the patch plate 8 is welded to the titanium layers 3. It is hard to prevent sea water from entering the space 10. In addition, this method is inapplicable for a structure that is to be flexurally processed because the space 10 expands when the structure is bent.

SUMMARY OF THE INVENTION

An object of the invention is to solve the problems of a covering arrangement disposed over a splash zone of a marine structure, in particular each support leg of the marine structure.

To achieve the object, an aspect of the invention provides the surface splash zone of the marine structure with a corrosion resistant covering material of titanium-clad steel plates. The plates are continuously arranged in vertical and horizontal directions and joined together. Long sides of the steel plates at the top and bottom steps of the corrosion resistant covering material are horizontally oriented to minimize the number of joints between adjacent said steel plates.

Another aspect of the invention seals a space formed at an exposed end face of each joint between adjacent steel plates at the top and bottom steps of the corrosion resistant covering material.

Still another aspect of the invention provides a sealing structure for an exposed end face of each joint between adjacent steel plates at the top and bottom steps of the corrosion resistant covering material, for preventing brittleness and corrosion of the joint.

Still another aspect of the invention covers a space to be formed, when an exposed end face of a joint is sealed, with weld metal, a titanium plate, or a plate made of the same metal as the weld metal.

Still another aspect of the invention forms a slot at each joint point between adjacent titanium-clad steel plates at the top and bottom steps of the corrosion resistant covering material, formes the exposed end face of the joint on the bottom of the slot, inserts a titanium-clad steel plate serving as a spacer into the slot, and joins the spacer with the adjacent steel plates, thereby forming a sealing cover.

In this way, the invention provides a marine structure having excellent corrosion resistance.

DESCRIPTION OF THE PREFERRED EMBODIMENTS

Figure 1:
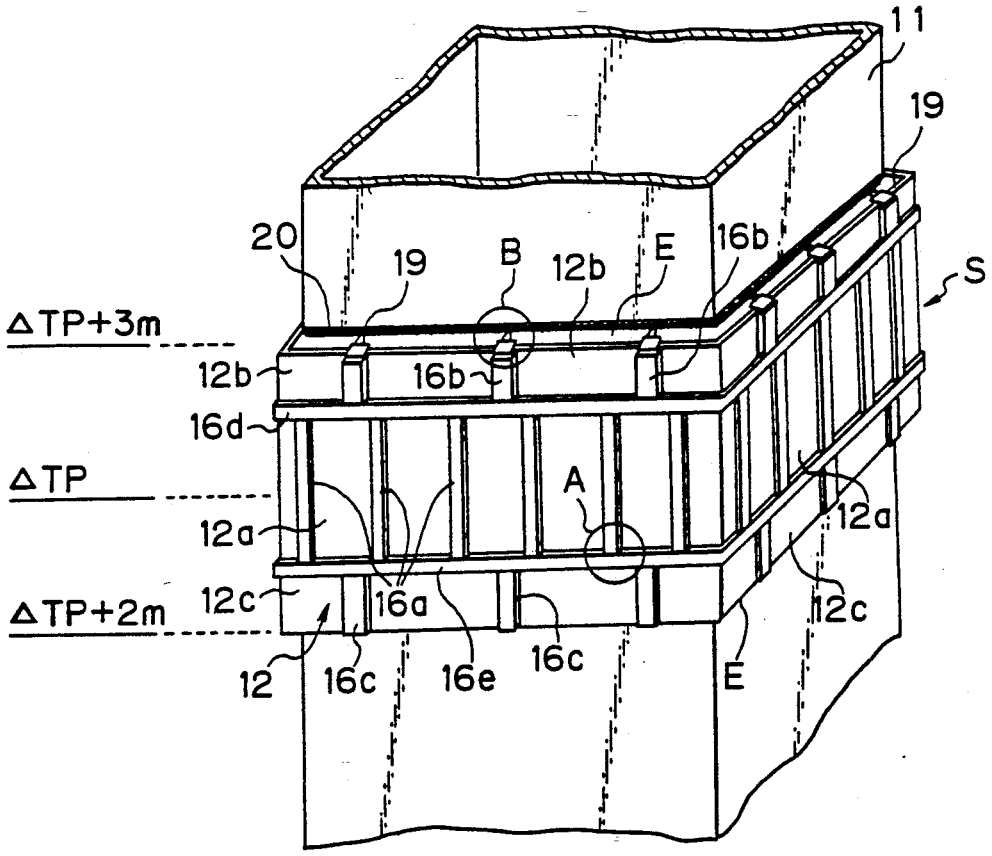
FIG. 1 is a perspective view showing an embodiment of the invention.

FIG. 1 shows a leg of an marine structure according to an embodiment of the invention.

In the figure, the leg 11 has a splash zone ranging from +3 m to −2 m from a sea water level ΔTP. The splash zone of the leg 11 is covered with a corrosion resistant covering material S of titanium-clad steel plates 12, continuously arranged in horizontal and vertical directions and joined together. Each of the plates 12 has a rectangular plane and is made of a pure titanium layer and a base reinforcing layer of carbon steel, low alloy steel, or high-tensile steel.

Figure 3:
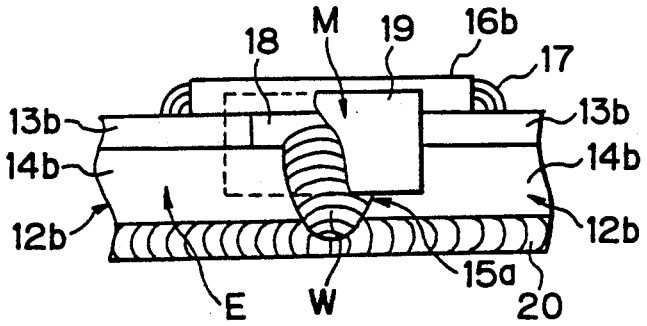
FIG. 3 is a partly broken enlarged view showing a part B of FIG. 1.

Although the surface of the corrosion resistant covering material S is covered with pure titanium layers, each edge E at the top and bottom steps thereof exposes welded joints W as shown in FIG. 3. The exposed welded joints W are vulnerable to sea water and easily corrode and become brittle when washed by sea water. Namely, the number of the exposed welded joints W must be minimized.

To achieve this, the invention arranges the titanium-clad steel plates 12 such that long sides of the plates **12*b* and 12*c*** at the top and bottom steps of the corrosion resistant covering material S are horizontally oriented, and adjacent short sides thereof are welded together. This reduces the number of the exposed welded joints, thereby minimizing brittle locations and improving the corrosion resistance of the structure.

In FIG. 1, long sides of the titanium-clad steel plates **12*a* at an intermediate step of the material S are vertically arranged. This does not limit the invention. For example, the long sides of the plates 12*a* may be horizontally arranged, similar to the plates 12*b* and 12*c***, or in any other ways.

Figure 2:
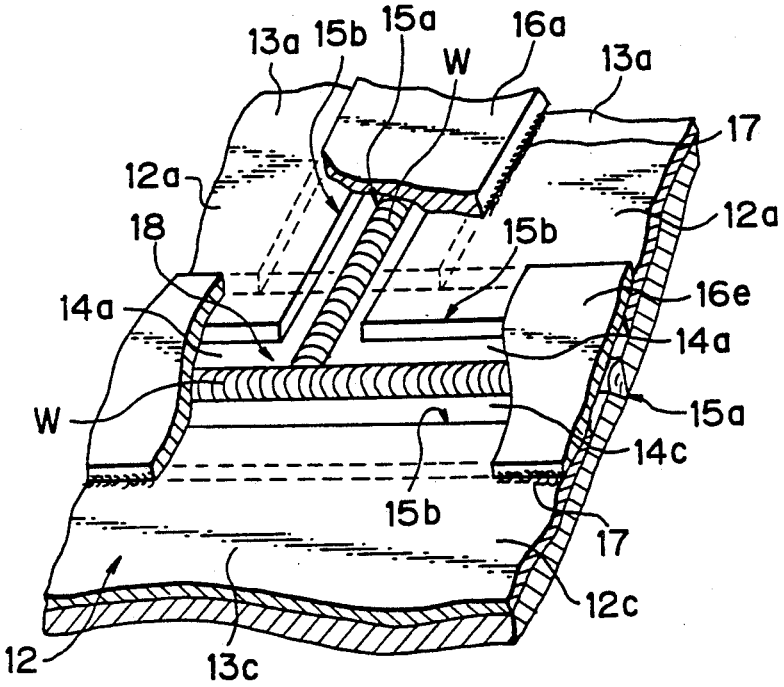
FIG. 2 is a partly broken enlarged view showing a part A of FIG. 1.

FIG. 2 is an enlarged perspective view showing a part A of FIG. 1. This figure shows examples of joints between adjacent steel plates **12*a* and between adjacent steel plates 12*a* and 12*c***.

In FIG. 2, an end side of each of the titanium layers **13*a*, 13*a* and 13*c* is cut into a groove 15*b*, while an end side of each of the carbon steel base layers 14*a*, 14*a*, 14*a* and 14*c* is cut into a groove 15*a*. The carbon steel base layers 14*a*, 14*a* and 14*b*** are butt-welded together by a tungsten inert gas (TIG) method.

At this time, spaces 18 are formed by the grooves **15*b* of the titanium layers 13*a*, 13*a* and 13*c*. To cover the spaces 18, patch plates 16*a* and 16*e* made of the same titanium material as the titanium layers 13*a*, 13*a* and 13*c* are bridged over the grooves 15*b* between the titanium layers 13*a*, 13*a* and 13*c*. The patch plates 16*a* and 16*e* are fillet-welded (17) with the titanium layers 13*a*, 13*a* and 13*c* Instead, spacers (not shown) may be inserted into the grooves 15*b*** to fill the grooves.

FIG. 3 is an enlarged side view showing a part B of FIG. 1 including one of the exposed welded joints W. At this part, the space 18 is exposed to introduce sea water to corrode the welded joint W of the base layers **14*b* and 14*b*. To prevent this, the invention covers the space 18 with a titanium plate 19. The titanium plate 19 is welded according to a sealed TIG method in an atmosphere of inert gas such as Ar and He with the use of an Ag-Cu-based composition, thereby forming a sealed cover M for covering the space 18** as well as the exposed welded joint W, if necessary.

The sealing cover M may be a flat plate made of the Ag-Cu-based composition, instead of the titanium plate. If the exposed space 18 is small, the sealing cover M may be formed by depositing the Ag-Cu-based composition.

When welding the sealing plate 19, it is preferable to deposit Co-based metal or Fe-Co-based metal as a base material on the base layers **14*b* and on the titanium layers 13*b* in the vicinity of the based layers 14*b*, and then weld the Ag-based sealing plate 19 on the base deposit. This prevents the mixing of Fe, C, etc., of the base layers 14*b*** with the Ag-based molten metal, and thereby prevents weakening of the joint.

Since the deposited metal allows dissimilar materials, i.e., steel and titanium to be welded together, the base layers and titanium layers are strongly joined together. Any material having good welding characteristics and corrosion resistance may be employed instead of the Ag-Cu-based material. For example, BAg8-based material or BAg8A-based material (Li of 0.015% to 0.3% added) according to JIS Z3261 may be employed. The material may contain Sn. Zn may be added to the material to an extent that will not deteriorate workability. If Zn is added, however, it causes fumes, so that the quantity of Zn to be added must be minimized. Ag and Sn suppress a low melting point and prevent a reaction with Fe and Ti, Cu improves the strength of a joint, and Li improves conformability with mild steel.

This invention employs a low melting point Ag-Cu-based composition that does not produce intermetallic compounds with titanium and steel, to weld dissimilar materials, i.e., titanium and steel together according to the TIG welding method. Since a heating speed of the TIG method is higher than that of brazing, the Ag-Cu-based composition is quickly melted and set without being excessively mixed with titanium and steel, to thereby properly weld the dissimilar metals.

In FIGS. 1 and 3, numeral 20 denotes a weld fillet formed between the leg 11 and the titanium-clad steel plates 12.

Figure 4:
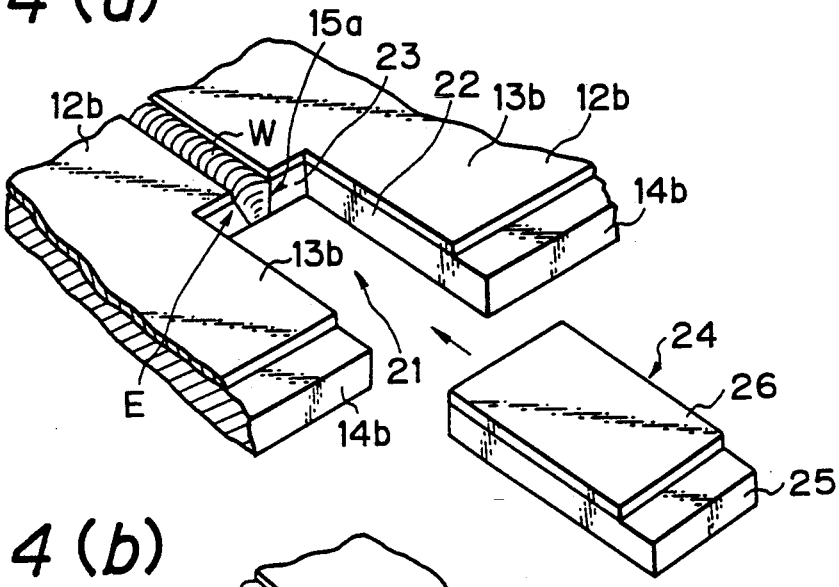
FIGS. 4(*a*) to 4(*c*) are perspective views showing an example of a sealing cover according to another embodiment of the invention, in which FIG. 4(*a*) shows the sealing cover before inserting a spacer, FIG. 4(*b*) shows the sealing cover after inserting the spacer, and FIG. 4(*c*) shows the completed sealing cover.
Figure 4:
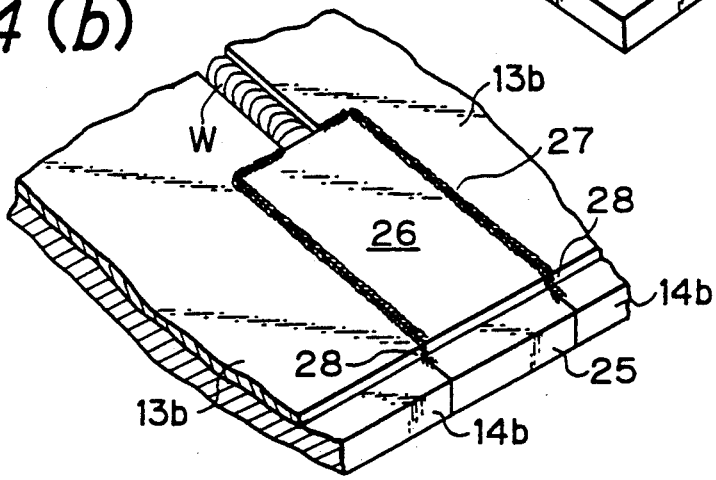
Figure 4:
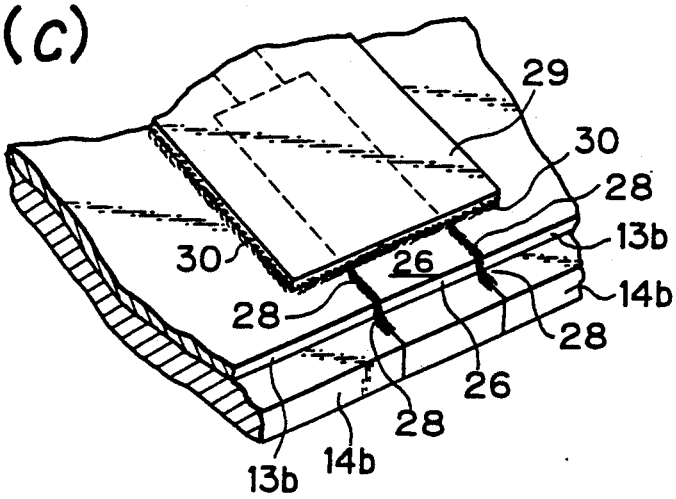
Figure 5:
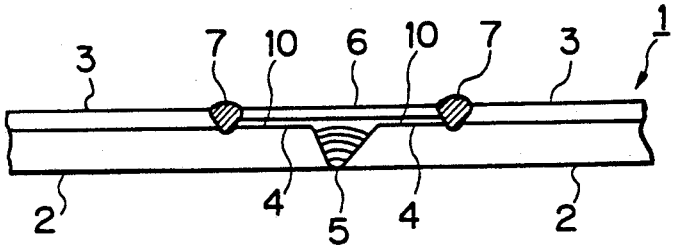
FIGS. 5(*a*) and 5(*b*) are views showing conventional sealing covers.
Figure 5:
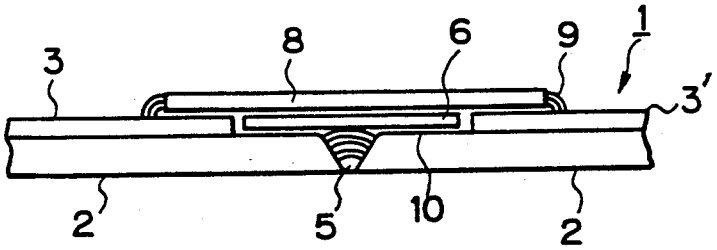

FIGS. 4(*a*) to 4(*c*) are views showing a sealing cover according to another embodiment of the invention.

In FIG. 4(*a*), titanium-clad steel plates **12*b* are joined together. Grooves 15*a* of base layers 14*b* (made of mild steel) of the plates 12*b* are welded together according to a TIG multilayer welding method, to form a welded joint W. A slot 21 is formed at the welded joint W along side edges of the titanium-clad steel plates 12*b*. The width of the slot 21 is wider than the width of the welded joint W. An end face E of the welded joint W is exposed on the bottom 23 of the slot 21. Numeral 22 denotes a side of the slot 21**.

A spacer 24 is prepared from a titanium-clad steel plate comprising a base layer 25 and a titanium layer 26. The spacer 24 is to be inserted into the slot 21. The width of the spacer 24 is slightly narrower than that of the slot 21.

In FIG. 4(*b*), the spacer 24 is inserted into the slot 21 to form a sealing cover M. The spacer 24 is welded to titanium layers **13*b* of the plates 12*b* according to the TIG method in an inert atmosphere of Ar or He with use of a Ti composition that is the same material as the spacer 24 and the titanium layers 13*b*. This welding process forms titanium weld portions 27**.

Dissimilar materials of Fe and Ti at an end of the spacer 24 are welded together according to the TIG method in an inert gas of Ar or He with the use of an Ag-Cu-based composition. This welding process forms dissimilar weld portions 28. Since the dissimilar weld portions 28 are linear joints, the strength of the joints is higher than that provided by brazing. This enables the welding process to be carried out at site. The Ag-Cu-based composition used in this welding process produces an Ag rich deposited metal that contains only a small quantity of Fe.

In FIG. 4(*c*), a patch plate 29 is applied over the welded joint W and spacer 24 and welded to the titanium layers 13*b*, 13*b* and 26, to form lap fillet weld portions 30. As a result, a space may be formed at the welded joint W between the titanium layers 13*b*, 13*b* and the patch plate 29. The space, however, is completely sealed with the spacers 24 welded at both ends of the space to prevent sea water from entering the space over the welded joint W and deteriorating and corroding the welded joint W.

As explained above, the invention provides a corrosion resistant covering material of titanium-clad steel plates that are disposed to minimize the number of welded joints at the top and bottom steps of the above material. Adjacent titanium-clad steel plates are joined together by a simple method. The welded joints are covered with titanium-clad members and patch plates, while an exposed end face of each of the welded joints is sealed with a sealing cover to prevent sea water from coming into the welded joints. With this arrangement, the invention provides a marine structure having excellent corrosion resistance.

We claim:

1. A marine structure having a surface splash zone that is to be in contact with splashing sea water, comprising:

a corrosion resistant covering material for covering the splash zone composed of rectangular titanium-clad steel plates that are continuously arranged in vertical and horizontal directions, long sides of the titanium-clad steel plates at the top and bottom steps of the anticorrosion covering arrangement are horizontally arranged, adjacent titanium-clad steel plates are joined together and integrated into the corrosion resistant covering material;

each of the titanium-clad steel plates is provided with grooves along each side thereof that face a corresponding side of an adjacent titanium-clad steel plate; the grooves formed at base layers of adjacent titanium-clad steel plates are welded; the grooves formed at titanium layers of adjacent titanium-clad steel plates are covered with and joined together through a patch plate made of the same material as that of the titanium layer; and a space formed at an exposed end face of each joint between adjacent titanium-clad steel plates at the top and bottom steps of the corrosion resistant covering material is sealed with a sealing cover.

2. An marine structure according to claim 1, wherein the sealing cover is made of a weld metal.

3. An marine structure according to claim 1, wherein the sealing cover is a cover plate.

4. An marine structure according to claim 1, wherein the sealing cover is made of the weld material formed with an Ag-Cu-based metal.

5. An marine structure according to claim 1, wherein the cover plate forming the sealing cover is a titanium plate or a metal plate of the same kind as the weld metal used for welding the covering plate.

6. A marine structure having a surface splash zone that is to be in contact with splashing sea water, comprising:

a corrosion resistant covering material for covering the splash zone composed of rectangular titanium-clad steel plates that are continuously arranged in vertical and horizontal directions, long sides of the titanium-clad steel plates at the top and bottom steps of the anticorrosion covering arrangement are horizontally arranged, adjacent titanium-clad steel plates are joined together and integrated into the corrosion resistant covering material, each of the titanium-clad steel plates is provided with grooves along each side thereof that face a corresponding side of an adjacent titanium-clad steel plate, the grooves formed at base layers of adjacent titanium-clad steel plates are welded, the grooves formed at titanium layers of adjacent titanium-clad steel plates are covered with and joined together through a patch plate made of the same material as that of the titanium layer, and an exposed end face of each joint between adjacent titanium-clad steel plates is formed at the bottom of a slot formed on one side of the titanium-clad steel plates at the top and bottom steps of the corrosion resistant covering material, and a spacer made of a titanium-clad steel plate is inserted into and joined with the slot, thereby forming a sealing cover for sealing the exposed end face of each joint.

7. A marine structure according to claim 6, wherein the joint of the sealing cover is formed with the use of an Ag-Cu-based composition.

* * * * *